United States Patent [19]

Guyton

[11] 4,148,524

[45] Apr. 10, 1979

[54] ADJUSTABLE HEIGHT SEAT

[76] Inventor: Floyd R. Guyton, 9365 NE. 120th, Kirkland, Wash. 98033

[21] Appl. No.: 903,620

[22] Filed: May 8, 1978

[51] Int. Cl.[2] ..... A47C 1/02

[52] U.S. Cl. ..... 297/345; 248/188.5; 248/407; 297/433; 297/437

[58] Field of Search ..... 108/146, 144; 248/188.2, 188.5, 407–409; 247/345, 423, 429, 433, 437

[56] References Cited

U.S. PATENT DOCUMENTS

| | | | |
|---|---|---|---|
| 264,458 | 9/1882 | Johnson | 108/145 |
| 397,851 | 2/1889 | Gifford | 297/270 |
| 581,486 | 4/1897 | Monkiewicz | 108/145 |
| 740,120 | 9/1903 | Graefe | 108/144 |
| 848,465 | 3/1907 | Homeyer | 108/145 |
| 942,975 | 12/1909 | Porter | 297/68 |
| 1,016,763 | 2/1912 | Nill | 108/144 |
| 1,697,093 | 1/1929 | Tevis | 248/407 X |
| 2,218,963 | 10/1940 | Stephenson | 108/144 |
| 2,446,127 | 7/1948 | Cramer | 108/144 |
| 2,565,100 | 4/1950 | Cramer | 108/136 |
| 2,600,735 | 6/1952 | Corneliussen et al. | 403/104 |
| 3,230,910 | 1/1966 | Olsson | 108/153 |
| 3,278,229 | 10/1966 | Bates | 297/345 |
| 3,642,320 | 2/1972 | Ward | 297/345 |
| 3,737,136 | 6/1973 | Snurr | 248/412 |
| 3,741,514 | 6/1973 | Snurr | 248/412 |

*Primary Examiner*—James C. Mitchell

*Attorney, Agent, or Firm*—Graybeal, Barnard & Uhlir

[57] ABSTRACT

An improved seat, including a support member having a plurality of legs extending rigidly outwardly therefrom. An upright tubular inner column is affixed to said support member and is telescopically engaged by an upright tubular outer column whose top carries a device for supporting a person. A vertically pivotable footrest is carried by the ends of a pivot shaft which is, in turn, carried by the outer column. In one embodiment a locking pin, carried by the footrest, is selectively engageable with any one of a plurality of vertically arranged locking holes located in the inner column. In another embodiment, the locking pin, carried by the pivot, is located within the inner column, and selectively engages one pair of a plurality of pairs of vertically arranged locking slots in the inner column. In both embodiments, the height of the seat is adjusted by pivotably lifting the footrest to selectively engage and disengage the locking pin and its associated locking hole or locking slots.

12 Claims, 13 Drawing Figures

ADJUSTABLE HEIGHT SEAT

BACKGROUND OF THE INVENTION

1. Field of the Invention

This invention relates to seats, and more particularly, to seats having a mechanism for selectively adjusting the height thereof.

2. Description of the Prior Art

There are many instances in which it is desirable that the height of a seat be selectively adjustable, according to the needs of the user. Accordingly, it is not surprising that there are many prior art devices which address themselves to providing such a seat.

Perhaps the simplest form of height adjustable seat is that disclosed by U.S. Pat. No. 3,230,910 granted Jan. 24, 1966, to Olsson, which comprises a conical base having a recess on the top thereof which receives a downwardly projecting cone depending from the seat. The height of the seat may be adjusted by interposing an intermediate member between the base and the downwardly projecting cone on the seat.

U.S. Pat. Nos. 2,218,963, granted Oct. 22, 1940, to Stephenson; 2,446,127, granted July 27, 1948, to Cramer; and 2,505,100, granted Apr. 25, 1950, to Cramer, disclose height adjustable stools in which the height of the stool is selected by use of a relatively complex and costly hydraulic apparatus.

U.S. Pat. Nos. 397,851, granted Feb. 12, 1889, to Gifford; 581,486, granted Apr. 27, 1897, to Monkiewicz; and 848,465, granted Mar. 26, 1907, to Homeyer disclose collapsible chairs or stools in which the height of the chair or stool is adjusted by folding hinged support members in selective amounts.

U.S. Pat. No. 2,600,735, granted June 17, 1952, to Corneliussen et al discloses a height adjustable seat in which a movable inner column, which supports the seat, is selectively locked with respect to the outer column by means of a locking disc 4, carried by the outer column, which encircles and selectively engages the inner column with a friction grip.

U.S. Pat. Nos. 3,737,136, granted June 5, 1973, to Snurr, and 3,741,514, granted June 26, 1973, to Snurr, each disclose a height adjustable support utilizing three concentric shafts. The inner and outer shafts are secured to a base while the middle shaft supports a seat and carries a locking device for height adjustment. In the first patent, the locking device comprises locking balls 25, contained within a tapered bore in a locking body 20, which frictionally engage the center shaft when weight is applied to the seat. In the second patent, the locking device comprises a wedge locking device 22 which also uses locking balls 32 as previously described.

U.S. Pat. No. 942,975, granted Dec. 14, 1909, to Porter, discloses a device for a shoe salesman comprising a footrest connected to the support post for a seat in such a way that when the seat is depressed, as by the weight of a person sitting on it, the footrest is elevated for use. The seat may be locked in positions of varying heights by means of detents 12 which selectively engage the notches 11 on the support post. The detents are carried by the column which encircles the support post.

U.S. Pat. No. 1,016,763, granted Feb. 6, 1912, to Nill, discloses a stool whose height is adjustable by selectively engaging the notches 20 in the supports 19 with the pins extending from the arms 15, 16. The pins pass through openings 11 in the legs 1 which enclose the supports.

U.S. Pat. No. 740,120, granted Sept. 29, 1903, to Graefe, discloses a height adjustable stand for flower pots in which a tooth 8 on a yoke-like lever 7, carried by a standard 2, selectively engages the stem's teeth 5 through the slot 6 in the standard 2.

U.S. Pat. No. 264,458, granted Sept. 19, 1882, to Johnson, discloses a height adjustable piano stool having two pairs of pivotally interconnected legs A and G between which is supported a cross member B. Cross member B supports an upwardly extending toothed shaft E about which a casing D extends. Casing D supports a lever H whose lower end d is arranged to selectively engage the notches e in the post d.

SUMMARY OF THE INVENTION

In basic form, the improved adjustable height seat of the present invention includes a base and a device for supporting a person, wherein the improvement comprises a generally vertical, tubular inner column supported by the base and carrying one height adjusting locking means part. A generally vertical, tubular outer column telescopically engages the inner column and has the device for supporting a person connected to its upper end. A rotatable footrest, which carries another height adjusting locking means part, is pivotally interconnected with the outer column. The height of the seat is adjusted by positioning the inner and outer columns as desired and then rotating the footrest to selectively engage and disengage said parts of the height adjustng locking means. This construction achieves the basic object of the present invention which is to provide a height adjustable seat in which the footrest carries part of a locking mechanism which is engaged and disengaged simply by pivotally rotating the footrest. A further object is to provide such a seat in which the spacing between the footrest and the device for supporting the person does not vary as the height of the seat is adjusted. This is achieved by the foregoing construction since, as the outer column is selectively positioned with respect to the inner column, the distance between the footrest and the device for supporting a person does not change because, of course, both are carried by the outer column.

A further aspect of the present invention specifies the inner column to be supported by a column supporting member which is part of the base. The base also includes a plurality of legs rigidly affixed to the column supporting member in a diverging relationship therewith. This construction helps applicant achieve a further object of the present invention which is to achieve a durable and reliable height adjustable seat having as few moving parts as possible in order to reduce the possibility that any particular moving part may wear out and fail.

A further aspect of the present invention specifies at least one of the inner and outer columns to carry a mechanism which prevents relative rotation of the inner and outer columns, to ensure correct alignment of the parts of the locking means.

Another aspect of the present invention specifies one of said legs of the seat to include an upwardly projecting footrest stowing pin which rotates the footrest to an upright, stowed position when the outer column, and hence the footrest, are in their lowest position with respect to the inner column. Such a construction helps to achieve another object of the present invention which is to provide a height adjustable seat having a footrest which is automatically stowed in an upright, out of the way position when the seat is positioned so low that the user can rest his feet upon the floor.

Another aspect of the present invention involves said one locking part in the form of a locking pin rigidly secured to the footrest. Said another locking part is in this instance in the form of a plurality of vertically aligned locking apertures in the inner column, with said locking parts engaging and disengaging depending upon the position of the footrest. Such a seat may also have the locking pin selectively engaging one of the locking apertures at a location adjacent the lower end of the outer column. This achieves another object of the present invention which is to ensure that the user is able to easily visually align the locking pin with whatever locking aperture is selected.

Another aspect of the present invention is characterized by said first locking part including a locking pin transversely secured to a pivot which forms part of the footrest. The second locking part in this instance is a plurality of spaced apart, radially opposed pairs of slots in the inner column, with said first and second locking parts selectively engaging and disengaging, depending upon the position of the footrest.

Further objects of the present invention are to provide a height adjustable seat which is quite safe by reason of its locking mechanism interlocking more securely when the weight of the user is upon it and which may be easily checked to ensure it is in a locked condition simply by noting the position of the footrest.

In some aspects of the present invention, safety is increased by sealing the tops of the inner and outer columns so that the air trapped therebetween acts as a pneumatic cushion to regulate the rate of lowering of the outer column when the locking mechanism is released. In some embodiments of the present invention an interlock may be provided to prevent inadvertent removal of the outer column from the inner column.

DESCRIPTION OF THE PREFERRED EMBODIMENTS

Figure 2:
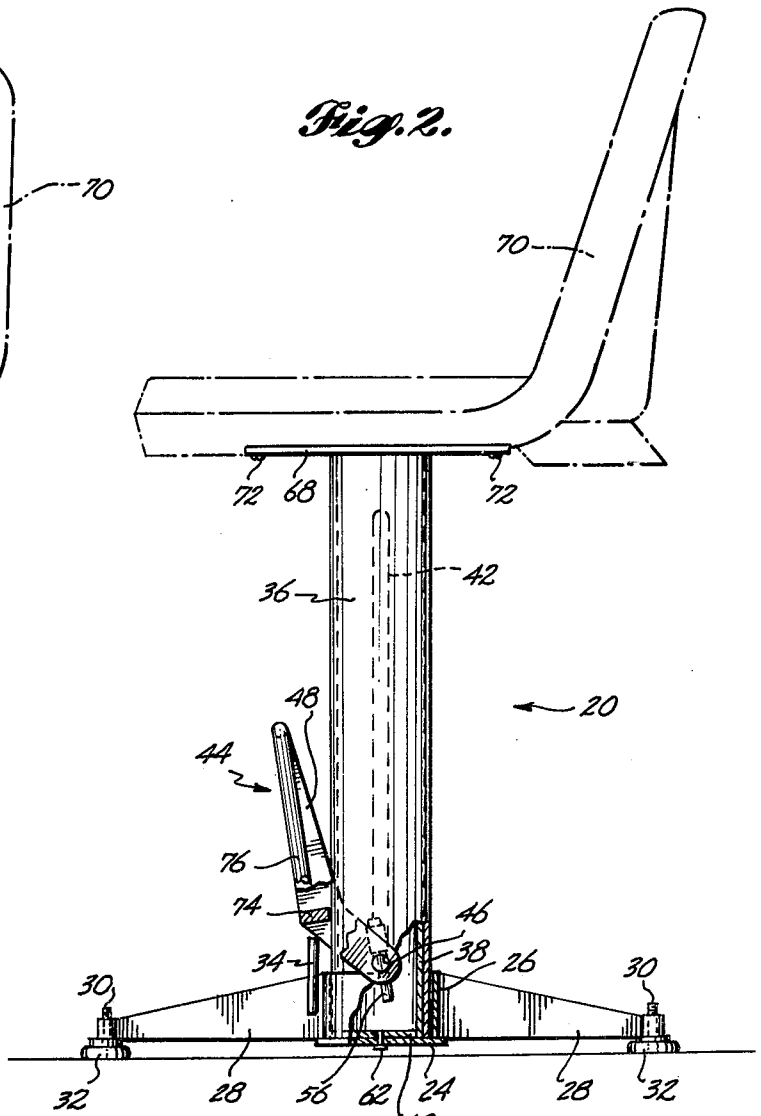
FIG. 2 is a side elevational view, with some parts broken away for clarity, of the seat shown in FIG. 1 with the locking mechanism shown disengaged, the seat in its lowest position, and the footrest in a stowed position.

Referring now to FIGS. 1–5 and 10, it will be seen that the improved height adjustable seat 20 of the present invention includes a base 22 comprising a base plate 24 which is secured, as by welding, to a tubular column support member 26. Radiating radially outwardly from the column support member, and affixed thereto as by welding, are four legs 28. To the end of each leg is secured, as by a fastener 30, a floor contacting disc member 32.

Figure 10:
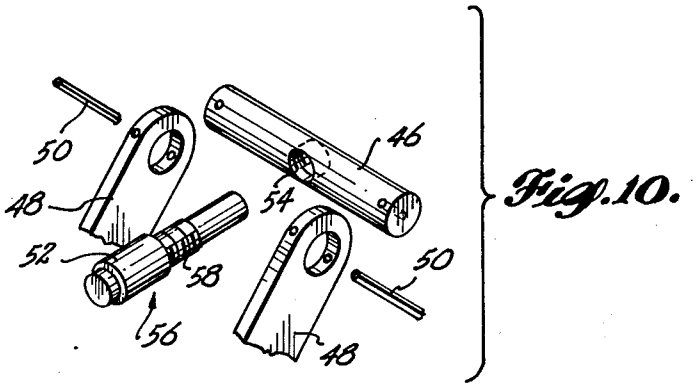
FIG. 10 is an exploded isometric view from an upper aspect some parts of the locking mechanism of the seat of FIG. 1.

A tubular outer column 36 is provided which telescopically engages the inner column 38 and is assembled thereto by passing the lower end of the outer column down over the inner column so that the pivot holes 40 of the outer column are located adjacent the bottoms of the longitudinal, radially opposed slots 42 on the inner column. Next, the footrest 44 is assembled to the outer column by the pivot 46, whose ends engage the footrest's support arms 48. It is understood that the pivot is journaled in the holes 40, extends through the slots 42, and is rigidly secured to the footrest arms 48 by the C-pins 50, as shown in FIG. 10.

Next, the footrest is pivotally moved to its upright, generally vertical position, as seen in FIG. 2, the locking pin 56 is passed through the bottom of the outer column 36 and into the locking pin hole 54 so that the threads 58 of the locking pin make a threaded connection with said pivot. Next, the nut 52 is tightly threaded onto one end of the locking pin 56 to thereby securely fasten together the pivot 46 and the locking pin 56.

Then, an end plate 60 is rigidly affixed to the base of the inner column 38, as by welding, and the end plate is, in turn, affixed to the base plate 24, of the base 22, as by a fastener 62 as seen in FIG. 2.

Figure 1:
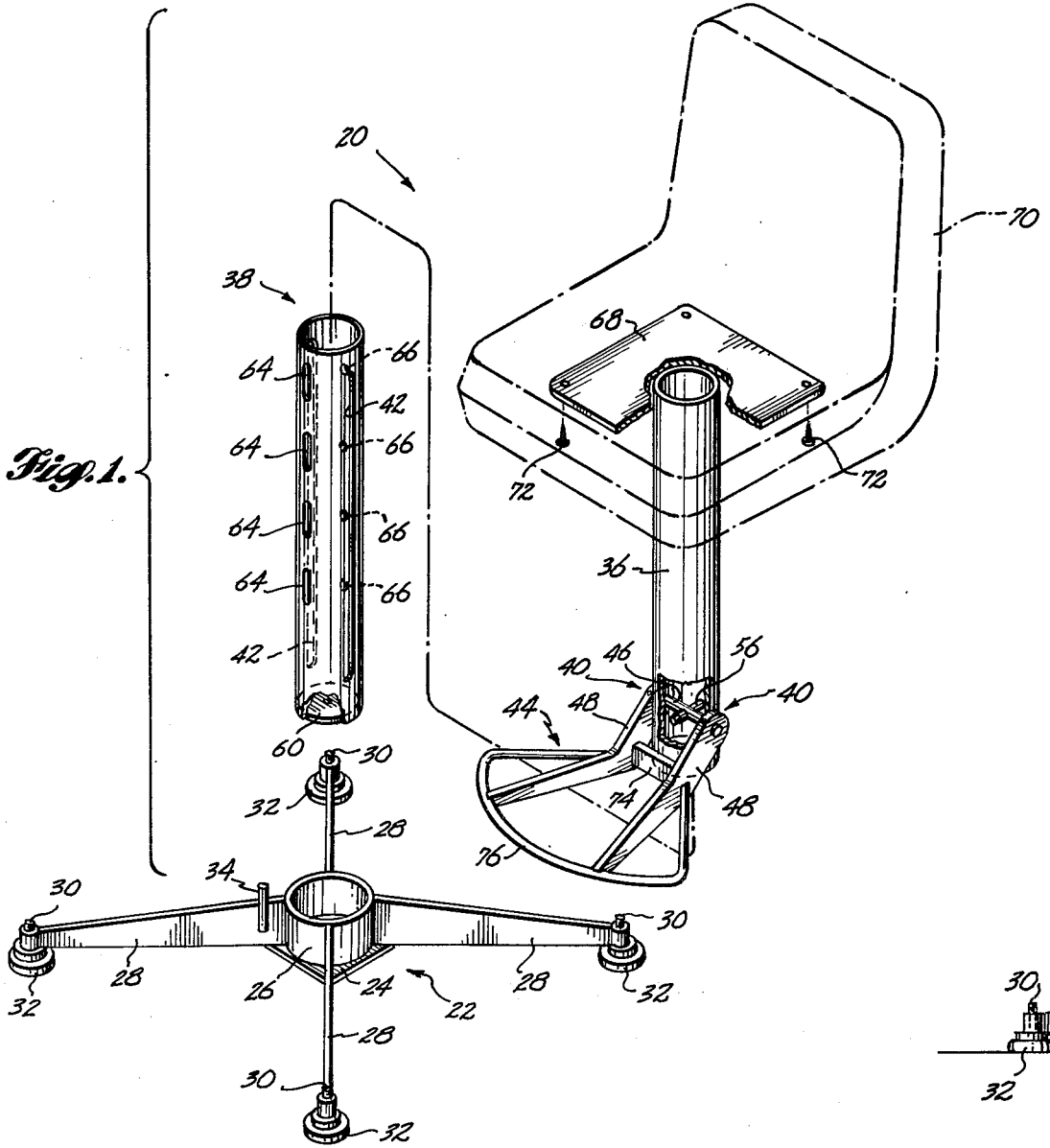
FIG. 1 is an exploded isometric view from an upper aspect of the improved height adjustable seat of the present invention.

Referring to FIG. 1, it is seen that the inner column 38 includes four pairs of vertically spaced apart, radially opposed locking slots 64, 66. Of course, although four pairs of the slots 64 and holes 66 are preferred, fewer or more pairs of said slots can be provided and the vertical spacing therebetween can be varied without departing from the scope of the present invention.

Figure 5:
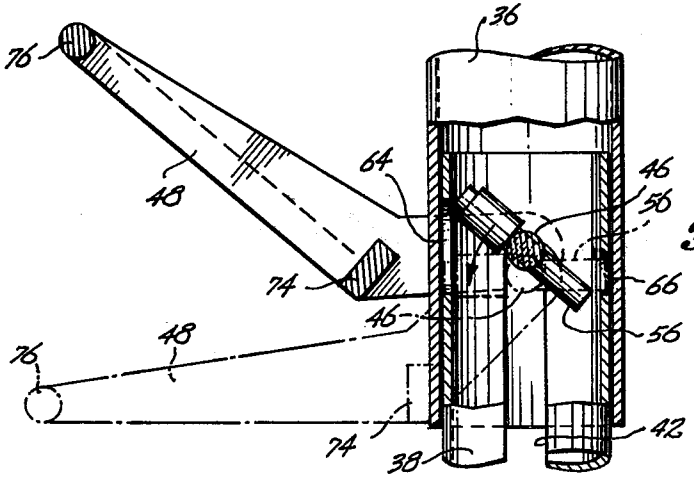
FIG. 5 is a side elevational view, with some parts broken away for clarity of the seat shown in FIG. 1 with the locking mechanism disengaged.

Referring to FIG. 5, it is seen that, although the slots 64, 66 are of unequal heights, the bottoms of each pair of slots are level with each other. The height of locking slot 66 is slightly larger than the diameter of the locking pin 56, the height of locking slot 66 is about four times the diameter of locking pin 56, and the length of the locking pin is less than the internal diameter of the inner column, in order to provide for proper engagement and disengagement of the locking pin with the locking slots.

Finally, a top plate 68 is rigidly secured to the top of the outer column 36, as by welding, and the device for supporting a person 70 is secured to the top plate, as by fasteners 72.

As seen, the footrest 44 comprises a pair of support arms 48 between which are secured, as by welding, a foot support bar 76 and a stop plate 74, the latter serving to help prevent rotation of the footrest downwardly past a generally horizontal position. Of course, it is understood that the exact sizing, shape and construction of the footrest can be varied from that shown without departing from the scope of the invention.

Referring now to FIG. 2, the seat 20 is seen to be in its lowermost position, with the bottom of the outer column 36 nestled within the column support member 26 adjacent the base plate 24. Footrest stowing pin 34 is located on a leg 28 so as to contact one of the footrest support arms 48 and automatically raise the footrest to its generally upright, stowed position as the outer column is lowered to its lowest position. If desired, a nylon or like plastic cap (not shown) can be placed over the top of pin 34, to obviate scratching of the portion of arm 48 contacted by the pin 34. As will also be observed, when the footrest is rotated into an upright position, the locking pin 56 is not in contact with any of the pairs of locking slots 64, 66 and thus the outer column may be freely raised relative to the inner column merely by exerting an upward force on the outer column.

Figure 4:
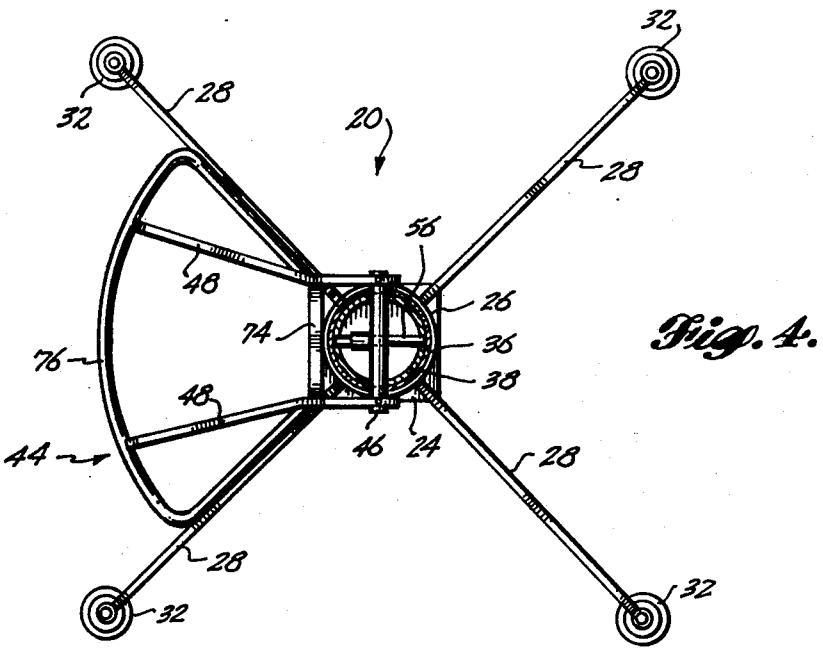
FIG. 4 is a cross-sectional view of the seat illustrated in FIG. 3 taken substantially along line 4—4 thereof showing the locking mechanism engaged.
Figure 3:
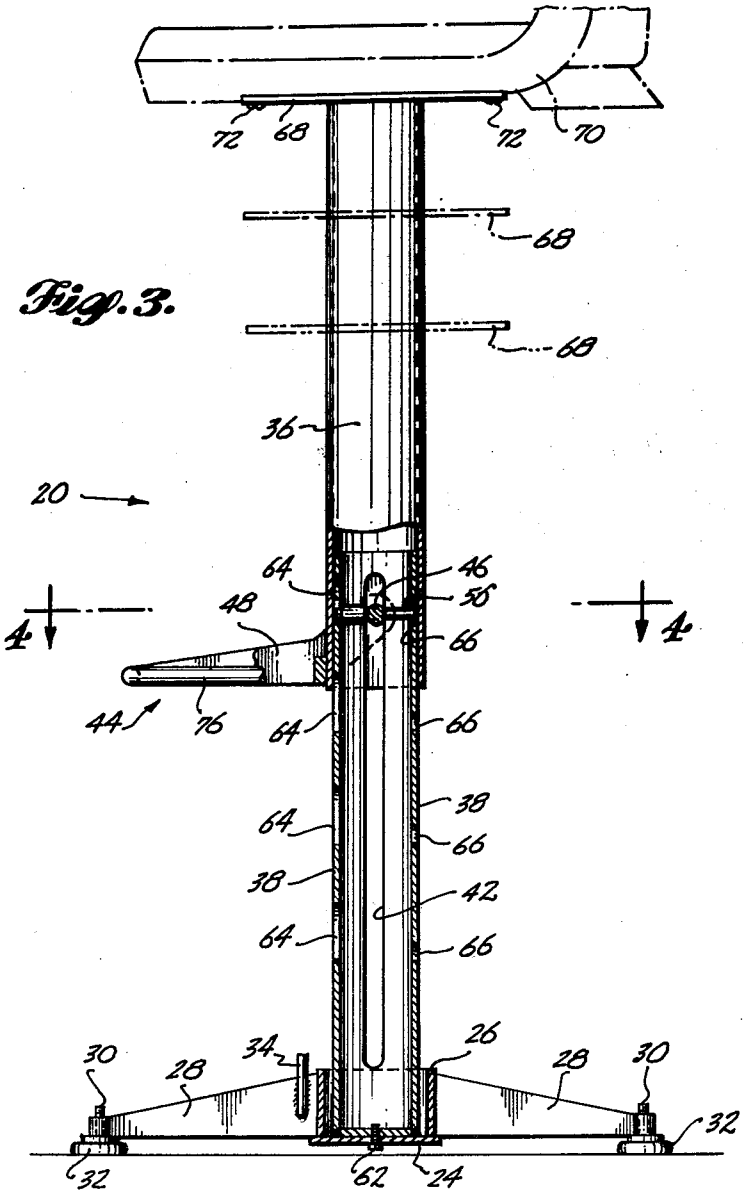
FIG. 3 is a side elevational view, with some parts broken away for clarity, showing the seat in an elevated position and the locking mechanism engaged.

Referring now to FIGS. 3 and 4, the height adjustable seat 20 is there shown with the outer column 36 locked in its highest position with respect to the inner column 38. The seat 20 is brought into this position from the position shown in FIG. 2 by maintaining the footrest in a raised posture, raising the outer column upwardly with respect to the inner column, and then pivoting the footrest downwardly, as best shown in FIG. 5, until the locking pin 56 engages the locking slots 64, 66.

To change the height of the seat 20 from that shown in FIG. 3, the locking pin 56 is disengaged from the locking slots 64, 66 merely by the user exerting an upward force on the outer column, to relieve the weight on the locking pin, and raising the outer column slightly as the footrest is pivoted upwardly, until the locking pin disengages from the locking slots. Then, the outer column may be raised or lowered to whatever height desired and the locking pin may be locked into whatever locking slot and hole pair is desired, as previously described, or the outer columm may be lowered completely to the base plate 24 as shown in FIG. 2.

It will be appreciated that the weight of the user upon element 70 is transferred through the pivot 46 to the locking pin 56. Thus, the present invention is very safe since the weight of the user tends to prevent any rotation of the locking pin which might tend to disengage it from the locking slots 64, 66 during use.

Another embodiment of the height adjustable seat 176 of the present invention is shown in FIGS. 6–9. Elements of the seat 176 which correspond to those shown in the seat 20 of FIGS. 1–5 and 10 are given corresponding prime reference numerals. Construction, assembly, and operation of these corresponding elements are generally the same, except as otherwise discussed.

The tubular inner column 38' includes six vertically spaced and aligned locking holes 78. As will be understood, the number and spacing of the locking holes can be varied without departing from the scope of the present invention. A clip 80 is secured inside the inner column 38' adjacent the top end thereof, as by a pair of fasteners 82. An elongate arm 84 is secured, as by a pair of fasteners 86, to the top plate 68' which is then rigidly affixed to the top of the outer column 36', as by welding. The device 70' for supporting a person is then connected to the top plate, as by the fasteners 72'.

Pivot housing 88 is rigidly secured to the outer column 36', as by welding. The footrest 44' is assembled to the outer column 36' by the pivot 90 which passes through the pivot housing 88. The ends of pivot rod 90 are rigidly secured to the support arms 48 by C-pins, not shown, as was done in the seat 20.

A support 92 is secured between the support arms 48', as by welding, and receives the locking pin 94 in hole 96 therein, the locking pin 94 being secured thereto, as by welding. Locking pin recess or hole 98 is formed in the bottom of the outer column which helps to prevent the outer column 36' from severing the pin 94 when weight is applied to the seat 176.

Figures 6, 7, 8, 9:
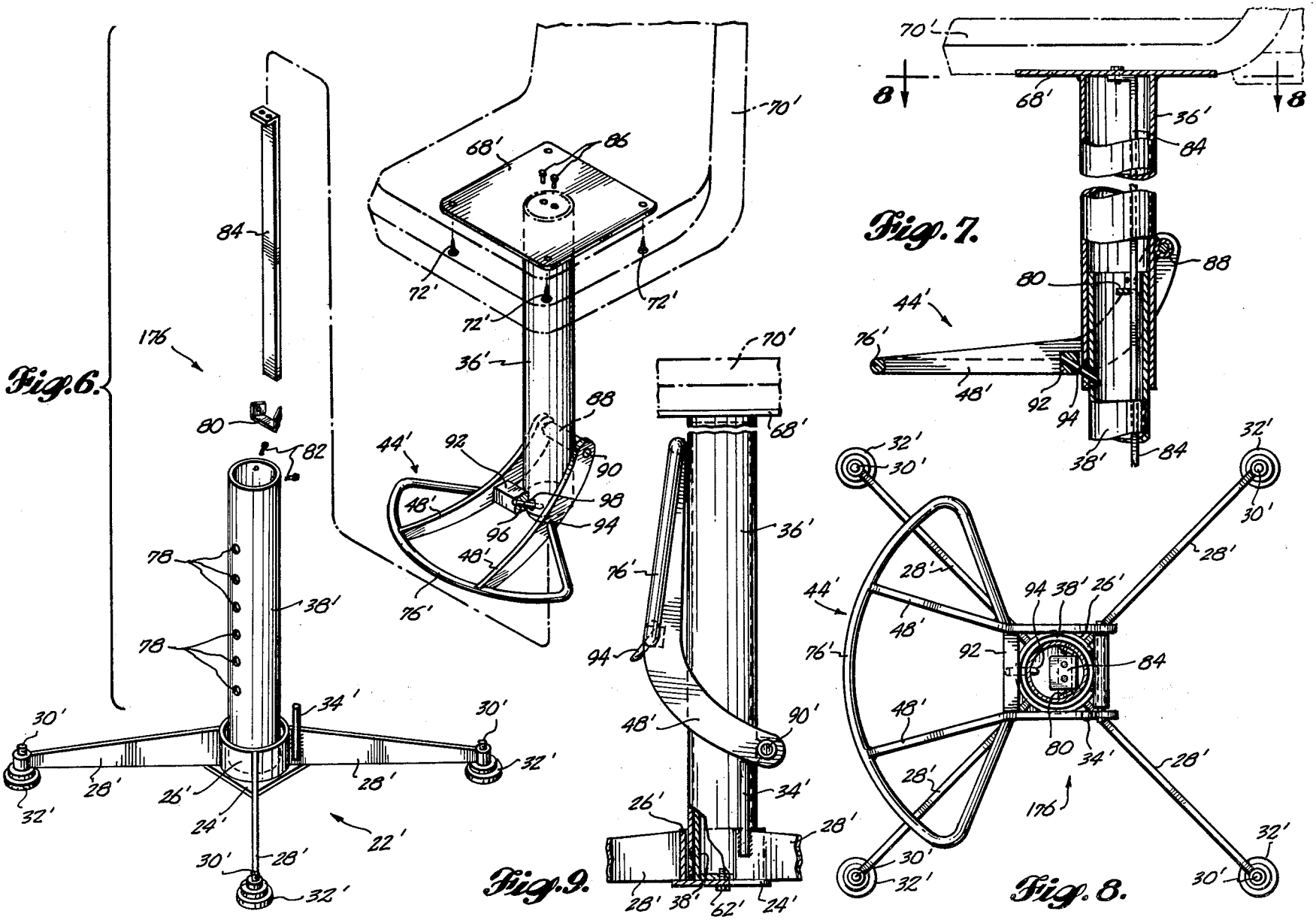
FIG. 6 is an exploded isometric view from an upper aspect of another embodiment of the improved height adjustable seat of the present invention.
FIG. 7 is a fragmentary side elevational view, with some parts broken away for clarity, of the seat shown in FIG. 6 showing the locking mechanism in a locked position.
FIG. 8 is a cross-sectional view of the seat shown in FIG. 7 taken substantially along line 8—8 thereof showing the locking mechanism in a locked position.
FIG. 9 is a fragmentary side elevational view, with some parts broken away for clarity, of the seat shown in FIG. 6 with the footrest in an upright, stowed position and the locking mechanism disengaged.

In order to assemble the outer column 36' to the inner column 38', the footrest 44' is rotated upwardly so that the locking pin 96 is spaced away from the locking pin recess or hole 98 in the outer column as seen, for example, in FIG. 9. Next, the outer column 36' is telescopically slid down over the inner column 38' so that the elongated arm 84 passes between the clip 80 and the inner column 38' as best seen in FIGS. 7 and 8. It will be appreciated that the purpose of the clip 80 and the arm 84 are to keep the locking pin 94 and the locking pin holes 78 aligned. Of course said clip and arm can be eliminated simply by configuring the inner and outer columns 38', 36' to be of noncircular cross section.

In order to adjust the height of the seat 176, all that is necessary is to pivot the footrest 44' upwardly so that the locking pin 94 is not engaged with any locking hole 78. Then, the outer column 36' is raised or lowered with respect to the inner column 38' until the desired locking hole is reached and the locking pin then falls into the desired locking hole, as seen in FIGS. 7–8.

As seen in FIG. 9, when the outer column 36' is slid downwardly until its lower end is adjacent the base plate 24' of the base 22', the footrest stowing pin 34' automatically rotates the footrest 44' into an upright, stowed condition. As seen, the pin 34' is secured to the leg 28', as by welding, in the location shown.

Referring now to FIG. 7, it is seen that the locking pin 94 is disposed at a moderately downward angle. This arrangement provides an important safety feature since the weight communicated to the pin 94 by the outer column tends to cause the pin 94 to engage more tightly in the locking hole 78 which receives it.

Another feature of the present invention is that, as will be readily understood, when the outer column 36' is raised, the locking pin 94 automatically engages a given locking hole 78. Thus, the pin 94 can be re-engaged with a higher locking hole 78 merely by raising the outer column 36' such that the pin is slightly above the desired locking hole 78. Then, merely by lowering the outer column, the pin 94 automatically engages the desired locking hole 78 due to the downward inclination of the locking pin 94 and the weight of the footrest 44'.

Figure 11:
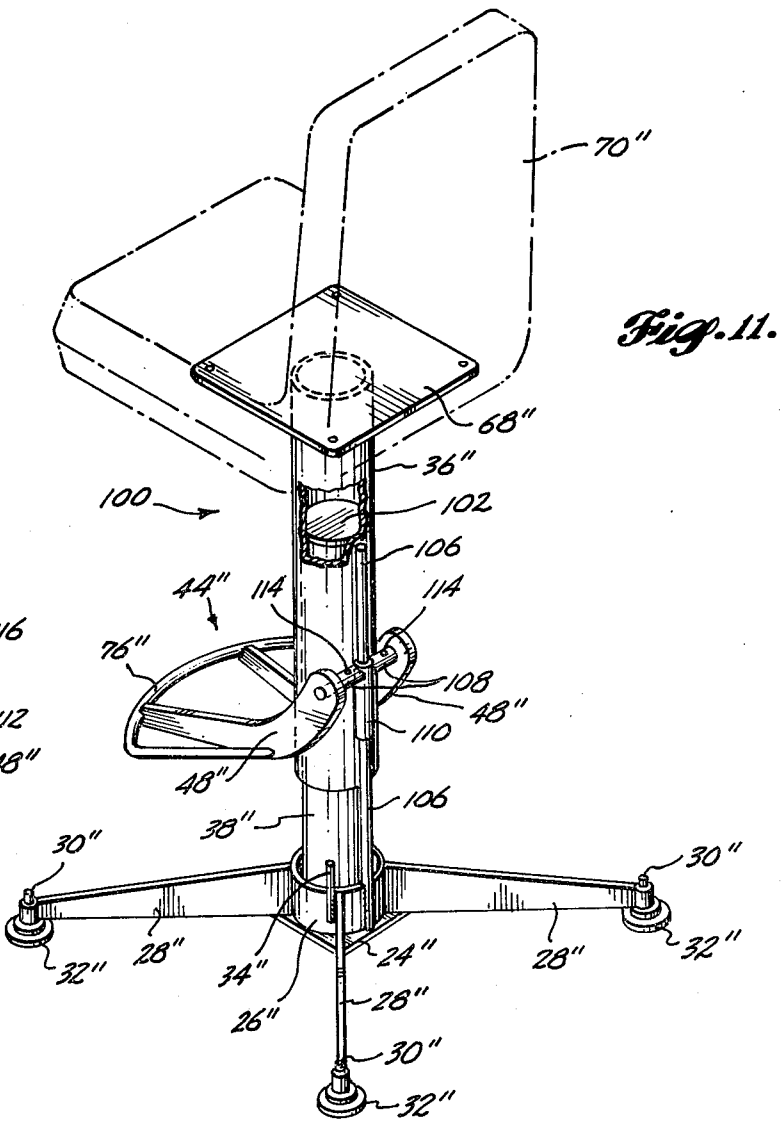
FIG. 11 is an isometric view of another embodiment of the present invention.

Turning now to FIGS. 10 and 11, a height adjustable seat 100 is shown which is very similar to the seat 176 shown in FIGS. 6–9. Elements of the seat 100 which correspond to those shown in the seat 176 of FIGS. 6–9 are given corresponding double prime reference numerals, i.e. support collar 26' becomes support collar 26''. Construction, assembly and operation of these corresponding elements are generally the same, except as otherwise discussed.

As is seen in FIG. 11, cap 102, and top plate 68 are sealingly secured, as by being press fit to the tops of the inner and outer columns 38'', 36'', respectively, so as to form an airtight attachment therewith. It is noted that the anti-rotation arm 84, clip 80 and fasteners 82, 86 of the seat 176 are eliminated in the seat 100. In lieu thereof, anti-rotation shaft 106 is secured to the column support member 26'' and the pivot mount 108 and the guide tube 110 are secured to the outer column, as by welding. The pivot mount 108 receives pivot pins 112 which are rigidly secured thereto as by C-pins 114. As shown, the ends of pivots 112 project only a short distance beyond the ends of the pivot mount 108. The footrest arms 48'' each contain a hole 116 which receives the end of its respective pivot 112. The footrest arms 48'' are assembled to the pivot pins 112 by the pivot pins 112 being passed through holes in the arms 48'', after which the C-pins 114 are located to lock same in position.

The outer column 36'' is assembled to the inner column 38'' by first rotating the footrest 44'' into an upright position, and then lowering the outer column 36'' over the inner column 38'' so that the guide tube 110 receives the anti-rotation shaft 106 therethrough. Guide tube 110 and the shaft 106 serve to prevent relative rotation between the inner and outer columns 38'', 36'', thereby keeping the locking pin 94' and the locking holes 78', not shown in FIG. 11, correctly aligned.

If desired, in order to ensure a relatively snug, sealing contact between the inner and outer columns, the top of the inner column can be wrapped with several turns of any suitable adhering plastic tape such as Mylar tape.

Operation of the seat 100 to raise and lower it is identical to that previously described with respect to seat 176, and hence is not again discussed.

As will be appreciated, air located within the outer column 36'' above the inner column 38'' forms a pneumatic cushion. This pneumatic cushion is an added safety feature in this form of the present invention and prevents sudden lowering of the seat 100 should the locking pin 96' somehow become disengaged from its associated locking hole 78' while a person is sitting upon the seat. If desired, the air sealing cap 102 may be provided with a conventional check valve (not shown) which is closed in the instance of increased air pressure below the cap 102 (as when the outer tube 36'' is moving downwardly) and is open in the instance of decreased air pressure above the cap 102 (as when the outer tube 36'' is being moved upwardly).

Figure 12:
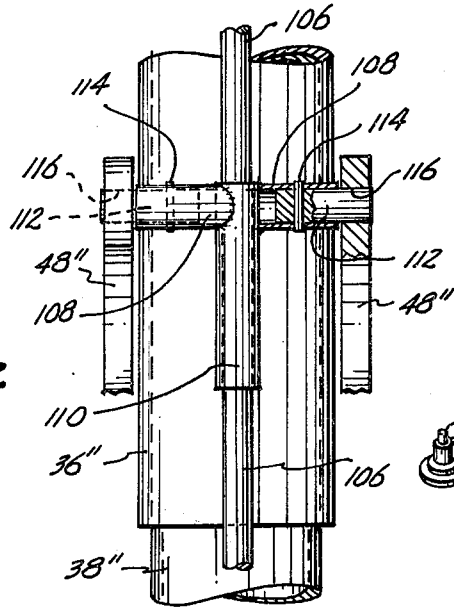
FIG. 12 is a side elevational view of a portion of the seat shown in FIG. 11.
Figure 13:
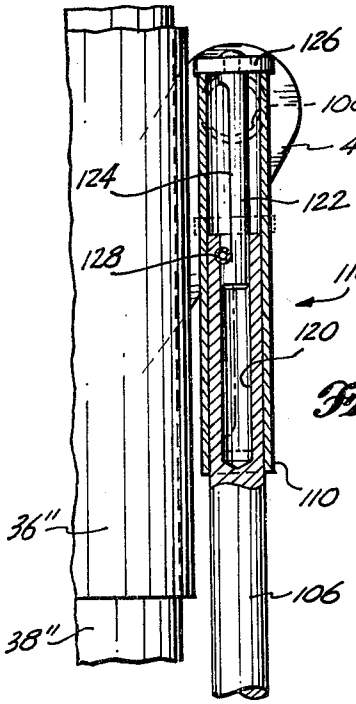
FIG. 13 is a view of a portion of the seat shown in FIG. 12 showing an interlock mechanism between the inner and outer columns.

Turning now to FIG. 13, an interlock device, generally designated at 118, is shown which can be added to the seat 100 shown in FIGS. 11–12 in order to prevent disengagement of the inner and outer columns 38'', 36''. In order to adapt the seat 100 to incorporate the interlock 118, first a hole 120 is bored into the top of the anti-rotation shaft 106. Then a shaft 122 having an elongated recess 124 and a cap 126 is inserted into the hole 120 and is retained therein by a C-pin 128 passing through the guide tube 110 and into recess 124. The cap is sized larger than the hole in the guide tube 110. It will be appreciated that when the outer column 36'' is lowered with respect to the inner column 38'', the interlock 118 is not activated. However as the outer column 36'' is raised with respect to the inner column 38'' so as to be near to disengagement therefrom, the top of the guide tube 110 engages the cap 126, thereby raising it and the shaft 122. When the bottom of the recess 124 engages the C-pin 128, further upward motion of the outer column 36'' is prevented, thereby preventing the inner and outer columns 38'', 36'' from becoming disengaged.

It will be understood that, for long life and durability, all the elements in the height adjustable chair 20, 176, 100 of the present invention, except for the device for supporting a person 70, 70', 70'', are preferably manufactured from a high strength, durable material such as steel. The device for supporting a person can be of any conventional construction and its shape and construction can be varied from that shown without departing from the scope of the present invention. Of course, a swivel mount, not shown, of any conventional construction can be provided at the top of outer column 36, 36', 36'' in order to permit the device for supporting a person 70, 70', 70'' to rotate with respect thereto.

From the foregoing, various further applications, modifications and adaptations of the apparatus disclosed and the invention embodied therein will now be apparent to those skilled in the art to which the invention is addressed, within the scope of the following claims.

What is claimed is:

1. An improved adjustable height seat of the type having a device for supporting a person and a base, wherein the improvement comprises:

(a) a generally vertical, tubular outer column telescopically engaging a generally vertical, tubular inner column and selectively movable vertically with respect thereto, wherein the lower end of said inner column is affixed to said base and the upper end of said outer column is connected to said device for supporting a person;

(b) a rotatable footrest means, including a pivot means, wherein said pivot means is interconnected with said outer column;

(c) a first height adjusting locking means part carried by said footrest means and movable therewith; and (d) a second height adjusting locking means part carried by said inner column;

wherein said first and second locking means parts are arranged to selectively engage and disengage each other by pivotal rotation of said footrest means, to adjust the height of said means for supporting a person.

2. The apparatus according to claim 1, wherein said base includes a column supporting member to which said lower end of the inner column is rigidly affixed, and said base further includes a plurality of legs rigidly affixed to said column supporting member in diverging relation therewith.

3. The apparatus according to claim 2, further comprising means, carried by at least one of said inner and outer columns, for preventing rotation of said inner and outer columns with respect to each other to ensure correct alignment of said first and second locking means with respect to each other.

4. The apparatus according to claim 3, wherein one of said legs includes an upwardly projecting footrest stowing means for rotating said footrest to an upright, stowed condition when said outer column is in about its lowest position with respect to said inner support means.

5. The apparatus of claim 3, wherein said means for preventing rotation comprise an elongated member having one end secured adjacent the top of said outer column and extending downwardly into said inner column and further comprising a bracket secured adjacent the top of the interior of the inner column, said elongated member passing between said bracket and said inner column.

6. The apparatus of claim 3, wherein said means for preventing rotation comprise an elongated shaft having its lower end secured to said base and its upper end passing through a guide tube secured to the exterior of said outer column.

7. The apparatus according to claim 6, further comprising interlock means for preventing said inner and outer columns from telescopically disengaging comprising stop means secured to the top of said elongated shaft.

8. The apparatus according to claims 1, 2, 3 or 4, wherein:

said pivot means includes a pivot;

said footrest means includes a footrest carried by the ends of said pivot;

said first locking means part includes a locking pin rigidly secured to said footrest; and said second locking means part comprises a plurality of vertically aligned locking apertures defined by said inner column;

wherein said locking pin and one of the locking apertures selectively engage each other when said footrest is rotated to about a generally horizontal locking position, and said locking pin and said one of the locking pin apertures are disengaged from each other when said footrest is rotated upwardly through at least a small angle.

9. The apparatus according to claim 8, wherein said locking pin selectively engages said one of the locking apertures at a location adjacent the lower end of said outer column; and said pivot means and said first locking means are located generally on opposite sides of said outer column.

10. The apparatus according to claims 1, 2, 3 or 4, wherein:

said pivot means include a pivot;

said inner column defines two longitudinal, radially opposed slots through which the pivot extends;

said outer column defines a pair of radially opposed apertures which journal said pivot;

said first locking means part is located substantially internally of said inner column and is rigidly secured to said pivot;

said second locking means part is located radially inwardly of said outer column; and said footrest means includes a footrest rigidly interconnected with the ends of said pivot at locations adjacent the outer surface of said outer column.

11. The apparatus according to claim 10, wherein:

said first locking means part further includes a locking pin transversely secured to said pivot and having a length slightly greater than the internal diameter of said inner column; and said second locking means part comprises a plurality of spaced apart, radially opposed pairs of slots defined by said inner column which selectively engage the ends of said locking pin when said locking pin is rotated into a generally horizontal locking position by rotation of said footrest into a generally horizontal locking position, and which disengage the ends of said locking pin when said footrest is rotated upwardly through at least a small angle.

12. The apparatus according to claims 1, 2, 3, or 4, wherein:

a cap is secured to the top of each of the inner and outer columns to form an air tight seal therewith; and there is a relatively snug, sealing, sliding contact between said inner and outer columns to entrap the air therebetween to prevent rapid lowering said seat when said locking means parts are disengaged.

* * * * *